US009648961B1

(12) United States Patent
Lovely

(10) Patent No.: US 9,648,961 B1
(45) Date of Patent: May 16, 2017

(54) TRANSLOCATABLE CHILD CARE CHANGING STATION

(71) Applicant: Angela Laverne Lovely, Deridder, LA (US)

(72) Inventor: Angela Laverne Lovely, Deridder, LA (US)

(73) Assignee: Angela Laverne Lovely, Deridder, LA (US)

( * ) Notice: Subject to any disclaimer, the term of this patent is extended or adjusted under 35 U.S.C. 154(b) by 117 days.

(21) Appl. No.: 14/623,376

(22) Filed: Feb. 16, 2015

(51) Int. Cl.
*A47D 5/00* (2006.01)
*A47C 19/04* (2006.01)

(52) U.S. Cl.
CPC ..... *A47D 5/00* (2013.01); *A47C 19/045* (2013.01)

(58) Field of Classification Search
CPC ..... A47D 5/00; A47C 19/045
USPC ..... 5/193
See application file for complete search history.

(56) References Cited

U.S. PATENT DOCUMENTS 836,397 A * 11/1906 McGough ..... A47C 19/045 108/49
1,487,341 A * 3/1924 Lange ..... A47D 5/00 5/2.1
4,768,242 A * 9/1988 LoTurco ..... A47D 7/03 5/100
5,161,270 A * 11/1992 Najmabadi ..... A47D 15/008 128/869
5,802,634 A * 9/1998 Onishi ..... A47C 19/045 40/727
5,829,948 A * 11/1998 Becklund ..... B66F 7/0625 187/237
5,934,641 A * 8/1999 Vince ..... A47D 9/005 248/165
2002/0195907 A1* 12/2002 Lawson ..... A47D 5/00 312/198
2003/0033672 A1* 2/2003 Jehn ..... A61G 1/0567 5/611
2004/0139543 A1* 7/2004 Courouzos ..... A47K 3/074 4/572.1
2006/0085913 A1* 4/2006 Kawakami ..... A47C 19/045 5/618
2007/0000059 A1* 1/2007 Brown ..... A47C 19/045 5/618
2007/0033730 A1* 2/2007 Bean ..... A47K 3/024 4/619
2009/0119837 A1* 5/2009 Benezra ..... A47D 15/008 5/424
2010/0257671 A1* 10/2010 Shimada ..... A47C 19/04 5/611

(Continued)

*Primary Examiner* — David E Sosnowski
*Assistant Examiner* — Myles Throop
(74) *Attorney, Agent, or Firm* — Williams Intellectual Property; Benjamin F. Williams

(57) ABSTRACT

A translocatable child care changing station having a horizontally disposed laying surface bounded by a plurality of guardrails, each of said plurality of guardrails positional between a raised, vertical orientation relative the laying surface and a horizontal orientation relative said laying surface, said laying surface securable upon a frame member disposed erectable upon a plurality of voluble leg members, each of said leg members moveable wherein the height of the laying surface is selectable at a desired position relative a user by action of a handle member, said handle member usable to effect securable positioning of each of said leg members.

9 Claims, 4 Drawing Sheets

(56) References Cited

U.S. PATENT DOCUMENTS

| | | | | |
|---|---|---|---|---|
| 2012/0167299 | A1* | 7/2012 | Tarquinio | A47D 7/03 5/93.1 |
| 2013/0086746 | A1* | 4/2013 | Vanderpohl | A61G 7/0507 5/428 |
| 2015/0285430 | A1* | 10/2015 | Wang | A47B 9/04 248/188.5 |
| 2015/0296998 | A1* | 10/2015 | Wyler | A47D 5/00 5/655 |

* cited by examiner

TRANSLOCATABLE CHILD CARE CHANGING STATION

BACKGROUND OF THE INVENTION

Various types of child changing stations and surfaces are known in the prior art. However, what is needed is a translocatable child care changing station that includes a horizontally disposed laying surface bounded by a plurality of guardrails, each of said plurality of guardrails positional between a raised, vertical orientation relative the laying surface and a horizontal orientation relative said laying surface, said laying surface securable upon a frame member disposed erectable upon a plurality of voluble leg members, each of said leg members moveable wherein the height of the laying surface selectable at a desired position relative a user by action of a handle member, said handle member usable to effect securable positioning of each of said leg members.

FIELD OF THE INVENTION

The present invention relates to a translocatable child care changing station, and more particularly, to a translocatable child care changing station having a horizontally disposed laying surface bounded by a plurality of guardrails, each of said plurality of guardrails positional between a raised, vertical orientation relative the laying surface and a horizontal orientation relative said laying surface, said laying surface securable upon a frame member disposed erectable upon a plurality of voluble leg members, each of said leg members moveable wherein the height of the laying surface is selectable at a desired position relative a user by action of a handle member, said handle member usable to effect securable positioning of each of said leg members.

SUMMARY OF THE INVENTION

The general purpose of the translocatable child care changing station, described subsequently in greater detail, is to provide a translocatable child care changing station which has many novel features that result in a translocatable child care changing station which is not anticipated, rendered obvious, suggested, or even implied by prior art, either alone or in combination thereof.

The present translocatable child care changing station has been devised to expedite changing of child diapers by a user in enabling securable position of a laying station at a desirable height relative said user, whereby repeated changing of a diaper is effective without a user having to stoop, bend over, or maintain awkward or uncomfortable positions of the body while effecting repeated changes of child diapers, as preferred.

The present translocatable child care changing station, therefore, includes a conformable laying surface accommodative of an infant there placed for diaper changing and child care, as desired. The laying surface is disposed upon a frame member and includes a plurality of guard rails disposed edgewise upon three sides of said laying surface, with one side left vacant for user access to a child there disposed.

Each of the plurality of guard rails is moveable between a vertical orientation relative the laying surface and a horizontal orientation relative the laying surface, whereby each of the plurality of guard rails is positional to vertically wall off three sides of the laying surface and, alternately, to extend the area of the laying surface at three edges thereof.

The frame member includes a horizontal portion, disposed underlying the laying surface and parallel therewith, and a vertical portion, disposed under a rearmost edge of the laying surface. A space is thus maintained between said laying surface and the horizontal portion of the frame member, said space usable for storage of items and accouterments beneficially accessible when administering child care and changing a diaper, said accouterments including, for example, talcum powder, baby powder, liniment, lotion, moisturizer, new diapers, and other such items and accessories desirously proximally maintained.

The frame member is disposed atop a plurality of leg members pivotally connected to an undersurface of a horizontal portion of said frame member. The plurality of leg members includes a first pair of leg members and a second pair of leg members. Each of the first and second pair of leg members includes a forward leg and a rear leg disposed in diagonal relation crossing at a pivotal midpoint thereon. A crossbar is disposed horizontally between each midpoint in parallel with the undersurface of the frame member horizontal portion, Each of a plurality of lockable wheels is disposed endwise upon each of the plurality of leg members in contact with an underlying ground surface, whereby the present device is voluble between locations across said ground surface, as desired. Each of said wheels is locakable, whereby rotation of each said wheel is preventable, and the present device therefore securable upon said ground surface, by action of each of a plurality of wheel brakes disposed to prevent rotation of each said wheel.

A piston member is disposed between the crossbar and the undersurface of the horizontal portion of the frame member. The piston is extensible when a handle member is manually engaged and lifted. Extension of the piston member raises the frame member relative each midpoint disposed upon the first and second pairs of leg members, whereby each forward leg is moved into a more parallel relation relative each rear leg, and the laying surface is effectively raised relative a user manipulating said handle member.

Action of the handle member in an opposite direction lowers the piston, whereby each forward leg is pivoted at the midpoint and where connected to the frame member undersurface, whereby each of the first and second pairs of leg members are scissored apart and the laying surface is thus lowered relative the user manipulating the handle member. A user may thus position the laying surface, and thusly a child thereon, to a desired height relative said user when about to engage in changing a diaper or other child care, as case may be.

A user may, therefore, wheel the present translocatable child care changing station to a child in need of changing, lower the laying surface to a desired height, place the child or infant thereupon, and thence raise the laying surface to a height more preferable to effecting changing of said child's diaper. Once child care has been concluded, the user may likewise lower the laying surface to remove the child therefrom. The translocatable child care changing station is then available for use with additional children or infants, as case may be.

Thus has been broadly outlined the more important features of the present translocatable child care changing station so that the detailed description thereof that follows may be better understood and in order that the present contribution to the art may be better appreciated.

Objects of the present translocatable child care changing station, along with various novel features that characterize the invention are particularly pointed out in the claims forming a part of this disclosure. For better understanding of the translocatable child care changing station, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
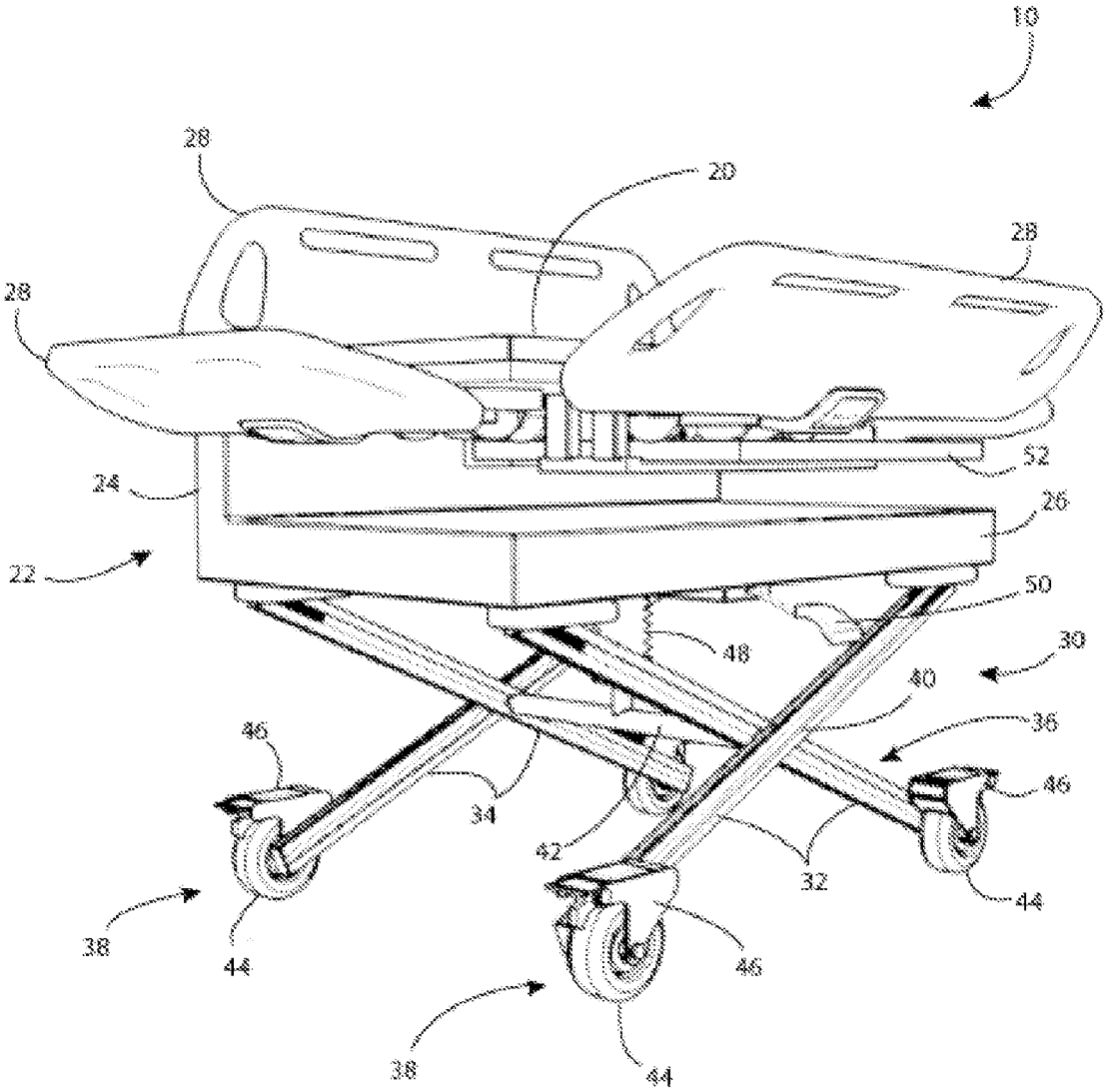
FIG. 1 is an isometric view of an embodiment.
Figure 2:
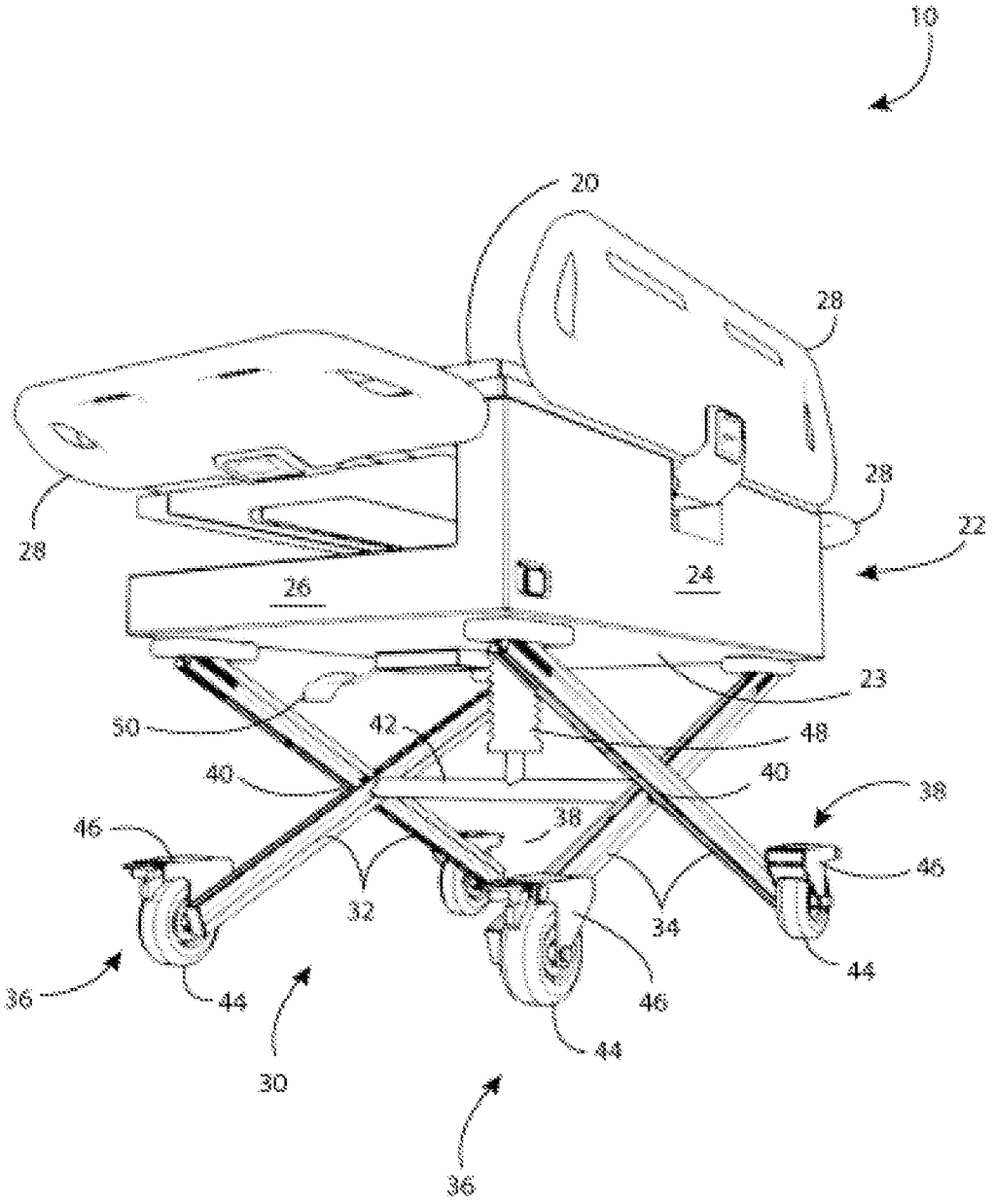
FIG. 2 is a lowered isometric view of an embodiment.
Figure 3:
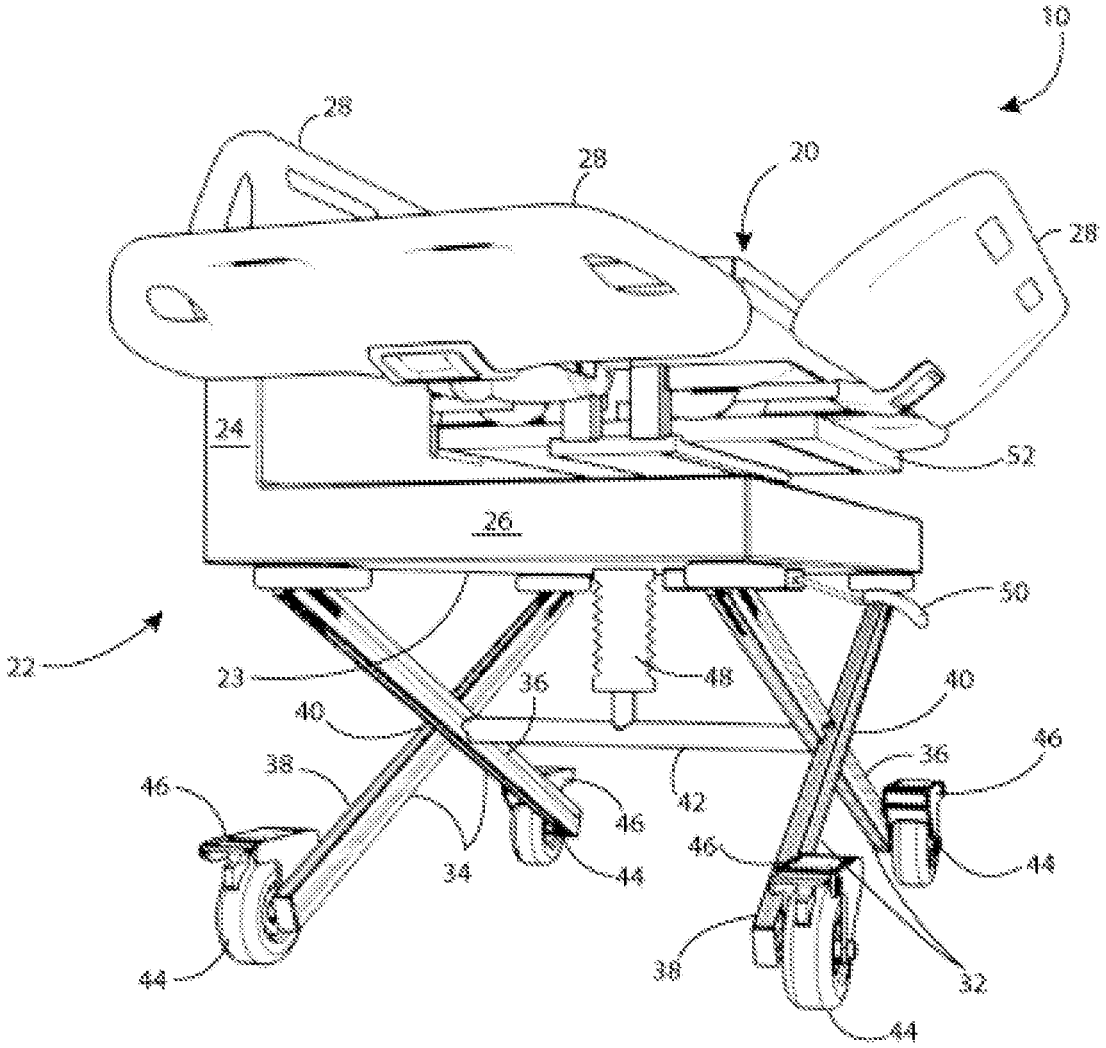
FIG. 3 is an endwise isometric view of an embodiment.
Figure 4:
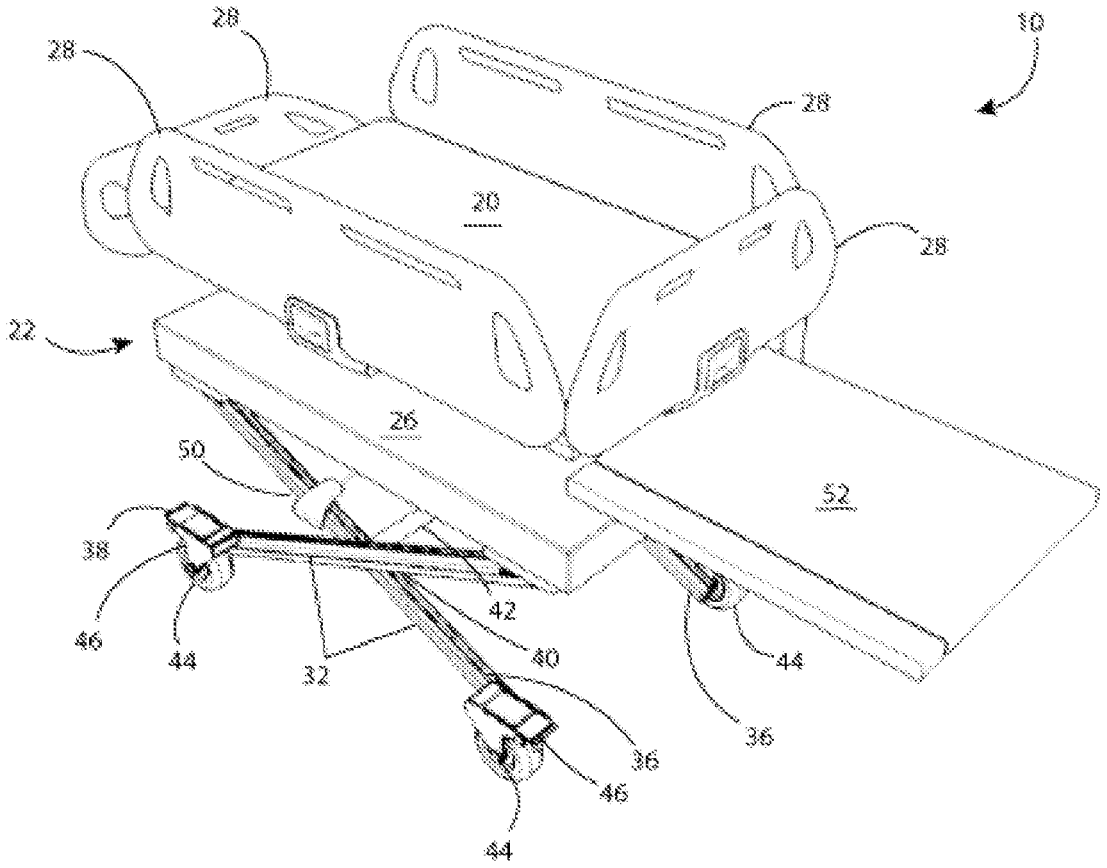
FIG. 4 is a raised isometric view of an embodiment.

With reference now to the drawings, and in particular FIGS. 1 through 4 thereof, example of the instant translocatable child care changing station employing the principles and concepts of the present translocatable child care changing station and generally designated by the reference number 10 will be described.

Referring to FIGS. 1 through 4 a preferred embodiment of the present translocatable child care changing station 10 is illustrated.

The present translocatable child care changing station 10 has been devised to enable a moveable, positional changing station for use in child care. The present translocatable child care changing station 10 includes a laying surface 20 raisable to a desired height and securable thereat, whereby a user may position a child, disposed supine upon a laying surface 20, at an appropriate position relative said user to enable comfortable changing of a diaper.

The present translocatable child care changing station 10, therefore, includes a frame member 22 disposed atop a plurality of voluble leg members 30. The frame member 22 includes a vertical portion 24 and a horizontal portion 26, said horizontal portion 26 disposed atop the plurality of leg members 30, said vertical portion 24 disposed overlying a second pair of said plurality of leg members 34 and congruent with the horizontal portion 26.

A soft and conformable laying surface 20 is disposed connected edgewise to the frame member 22 vertical portion 24, said laying surface 20 thereby disposed overlying and parallel the frame member 22 horizontal portion 26. A space is thereby partitioned between the laying surface 20 and the horizontal portion 26 of the frame member 22 wherein items and accouterments may be disposed for storage or convenience when using the device 10, such as, for example, baby powder, clean diapers, lotion, and other such accouterments desirably proximal when repeatedly changing a baby's diaper.

An extendible table surface 52 is disposed upon the laying surface 20 between said laying surface 20 and the horizontal portion of the frame member 22, said extendible table surface 52 selectively positional thereat between an extended position, disposed in a plane parallel with, and disposed sagittal relative a longitudinal axis of the laying surface 20, whereby a user may deploy said extendible table surface 52 for use, as desired, as a surface proximally disposed upon which to position accouterments for convenience while changing a child disposed upon the laying surface 20.

A plurality of guardrails 28 is disposed bounding the laying surface 20 on at least three sides, each of said plurality of guardrails 28 positional between a raised, vertical orientation relative the laying surface 20 and a horizontal orientation relative said laying surface 20, whereby each of said plurality of guardrails 28 is moveable between a lowered position and a raised position, positional thereat to bound at least three sides of the laying surface 20 and vertically enclose said laying surface 20, and alternately extend the area of the laying surface 20 horizontally for extended use thereof. One side of the laying surface 20 may be left unobstructed without a guardrail present, whereby access to the laying surface 20 is maintained for a user interacting with a child disposed thereupon.

The plurality of voluble leg members 30 is disposed underneath the frame member 22, said plurality of leg members 30 comprising a first pair of leg members 32 and a second pair of leg members 34 disposed pivotally connected cornerwise to an undersurface 23 of the frame member 22. Each of said first and second pairs of leg members 32, 34 includes a forward leg 36 and a rear leg 38 disposed diagonally relative one another, each said forward leg 36 crossing each said rear leg 38 at a pivotal midpoint 40 thereat. Each of said first and second pairs of leg members 32, 34 is connected together by a crossbar 42 disposed breadthwise between each midpoint 40 in parallel with the laying surface 20.

Each of a plurality of locakable wheels 44 is disposed endwise on each of the plurality of leg members 30 in contact with an underlying ground surface. Each of the plurality of lockable wheels 44 is lockable by action of a wheel brake 46, whereby volubility of each said wheel 44 is arrested when said wheel brake 46 is engaged and displacement of the translocatable child care changing station 10 is preventable across the ground surface by rotation of said wheels 44.

A piston member 48 is vertically disposed between the undersurface 23 of the frame member 22 and the crossbar 42. The piston member 48 is actionable to effect scissoring of each forward and rear leg 36, 38 to raise and alternately lower the frame member 22. When the piston member 48 is extended, each forward leg 36 is scissored in closer relation with each corresponding rear leg 38 towards a vertical extremity wherein each forward leg 36 and rear leg 38 would be parallel in vertical alignment, whereby the frame member 22 is raised toward said vertical extremity. When the piston member 48 is lowered each forward leg 36 and each corresponding rear leg 38 is moved farther apart towards a horizontal extremity wherein each forward leg 36 and rear leg 38 would be parallel in horizontal alignment, and the frame member 22 is thereby lowered toward said horizontal extremity.

Each of the plurality of leg members 30 pivots about the midpoint 40 where each forward leg 36 and rear leg 38 cross, and also at a position where each leg member 30 connects to the undersurface 23 of the horizontal portion 26 of the frame member 22.

Action of the piston member 48 is controllable by action of a handle member 50 disposed upon the frame member 22. The handle member 50 is disposed for manual engagement of the piston member 48 to effect raising, lowering, and securable positioning of the laying surface 20 to elevate a child disposed upon said laying surface 20 to a height comfortable for interaction with a particular user wielding the device 10.

The piston member 48 may be effective by electrical action, mechanical action, or hydraulic action. Raising the handle member 50 extends the piston member 48 and raises the frame member 22, drawing each of the forward leg members 36 closer to each of the rear leg members 38. Lowering the handle member 50 likewise lowers the piston member 48, spreading each forward leg member 36 apart from each rear leg member 38, whereby the frame member 22 and laying surface 20 are lowered relative a ground surface.

A user may thus translocate the present translocatable child care changing station to a desired position most convenient to effect changing a child's diaper and thereat raise and lower the laying surface 20 to position a child at a desired height relative said user, whereby repeated changing of diapers is more readily and comfortably effected without a user having to repeatedly stoop, bend over, or otherwise stress said user's body in the repetitive act of changing diapers, as desired.

What is claimed is:

1. A translocatable child care changing station comprising:

a frame member;

an undersurface of the frame member;

a plurality of voluble leg members disposed upon the undersurface of the frame member, said plurality of leg members including:

a first pair of leg members;

a second pair of leg members spaced apart from the first pair of leg members, each of said first and second pair of leg members having a forward leg and a rear leg disposed diagonally relative one another, said forward leg crossing the rear leg at a midpoint thereat, wherein each of the first and second pairs of leg members are connected by a crossbar disposed breadthwise between each midpoint and parallel the laying surface;

a horizontally disposed laying surface securable upon the frame member;

a plurality of guardrails disposed bounding said laying surface, each of said plurality of guardrails positionable between a raised, vertical orientation relative the laying surface and a horizontal orientation relative said laying surface;

a handle member; and a piston member disposed endwise between the undersurface of the frame member and the crossbar, said piston member extendable when the handle member is actioned to extend the leg members;

wherein the height of the laying surface is selectable at a desired position relative a user by action of the handle member, said handle member usable to effect securable positioning of each of said leg members.

2. The translocatable child care changing station of claim 1 wherein the piston member is electrically effective.

3. The translocatable child care changing station of claim 2 wherein each midpoint is pivotable and each forward leg and each rear leg scissors thereabouts.

4. The translocatable child care changing station of claim 3 wherein the piston member raises the frame member by scissor action of the leg members.

5. The translocatable child care changing station of claim 4 wherein the frame member includes a vertical portion and a horizontal portion, said horizontal portion disposed underlying the laying surface whereat storage of accouterments is enabled thereupon.

6. The translocatable child care changing station of claim 5 wherein an extendible table surface is disposed upon the laying surface between said laying surface and the horizontal portion of the frame member, said extendible table surface deployable thereat between a stowed position, disposed parallel and underlying the laying surface, and an extended position, disposed extended in a plane parallel with, and in a position sagittal relative, any longitudinal axis of said laying surface.

7. A translocatable child care changing station comprising:

a frame member having a vertical portion and a horizontal portion;

a laying surface disposed connected edgewise to the frame member vertical portion, said laying surface having an undersurface disposed overlying and parallel the frame member horizontal portion;

a plurality of guardrails disposed bounding the laying surface on three sides, each of said plurality of guardrails positional between a raised, vertical orientation relative the laying surface and a horizontal orientation relative said laying surface;

an extendible table surface disposed upon the laying surface, said extendible table surface disposed between the laying surface and the horizontal portion of the frame member and deployable thereat between a stowed position, disposed parallel and underlying the undersurface, and an extended position, disposed extended in a plane parallel with, and in a position sagittal relative, a longitudinal axis of the laying surface;

a plurality of voluble leg members disposed underneath the frame member, said plurality of leg members comprising a first pair of leg members and a second pair of leg members disposed pivotally cornerwise upon an undersurface of the frame member, each of said first and second pairs of leg members comprising:

a forward leg and a rear leg disposed diagonally relative one another, said forward leg crossing said rear leg at a pivotable midpoint thereat, each of said first and second pairs of leg members connected together by a crossbar disposed breadthwise between each midpoint parallel the laying surface;

a piston member disposed between the undersurface of the frame member and the crossbar, said piston member actionable to effect scissoring of each forward and rear leg to raise and alternately lower the frame member;

a handle member disposed for manual engagement of the piston to effect raising, lowering and securable position of the laying surface; and each of a plurality of lockable wheels disposed endwise on each of the plurality of leg members;

wherein the laying surface is securable at a desired height by action of the piston and a user may secure said laying surface at a desired position when changing a child.

8. The translocatable child care changing station of claim 7 wherein action of the piston member is electrically effective.

9. The translocatable child care changing station of claim 7 wherein the piston member is hydraulic.

* * * * *